US005236522A

United States Patent [19]

Fukuda et al.

[11] Patent Number: 5,236,522

[45] Date of Patent: Aug. 17, 1993

[54] FE-NI-CO ALLOY FOR A SHADOW MASK

[75] Inventors: Norio Fukuda; Naofumi Nakamura, both of Shizvoka; Atushi Hattori; Hideya Itoh, both of Kyoto; Akira Makita, Kamifukuoka; Tsutomu Hatano, Kyoto, all of Japan

[73] Assignees: Yamaha Metanix; Mitsubishi Electric Corp.; Dainippon Printing Co., Ltd., all of Japan

[21] Appl. No.: 951,099

[22] Filed: Sep. 25, 1992

[30] Foreign Application Priority Data

Sep. 27, 1991 [JP] Japan ..... 3-276723

[51] Int. Cl.[5] ..... C22C 38/08

[52] U.S. Cl. ..... 148/336; 420/95

[58] Field of Search ..... 148/336; 420/95

[56] References Cited

U.S. PATENT DOCUMENTS 5,026,435 6/1991 Nakamura et al. ..... 420/95

FOREIGN PATENT DOCUMENTS 61-19737 1/1986 Japan ..... 148/336

*Primary Examiner*—Deborah Yee

*Attorney, Agent, or Firm*—Ostrolenk, Faber, Gerb & Soffen

[57] ABSTRACT

In an Fe-base alloy, Ni is contained by 28 to 34% by weight and Co by 2 to 7% by weight with an average grain size of 30 μm or less. 60 to 95% of crystal grains are oriented in a range of ±5 to 45 degrees deviated from the ideal orientation of {100} [001]. Resultant low thermal expansion of the alloy assures high doming characteristics of a shadow mask made thereof.

2 Claims, 7 Drawing Sheets

FE-NI-CO ALLOY FOR A SHADOW MASK

BACKGROUND OF THE INVENTION

The present invention relates to an Fe-Ni-Co alloy for a shadow mask, and more particularly relates to improvement in function of a low thermal expansible, thin Fe-Ni-Co alloy plate used for production of shadow masks in the electronic and electric industries.

A shadow mask used for covering inside of a display screen of a cathode-ray tube for an electronic or electric device is provided with openings for directing electron beams to a given part of fluorescent plane. Conventionally, soft-steel plates made of, for example, low-carbon rimmed steel or low-carbon Aluminum-killed steel have been used for production of such shadow masks.

As well known, doming usually occures in radiation of electron beams through a shadow mask. That is, some of the radiated electron beams do not go through the opening of the shadow mask and causes its thermal expansion through heating by electron impingement upon the shadow mask. Being influenced by this thermal expansion, electron beams passing through the holes of the shadow mask cannot be correctly directed to a given part of the fluorescent plane. This fault in electron radiation is called "doming" in the field of the electronic and electric industries.

As stated above, soft-steel plates are widely used for production of shadow masks. Relatively high thermal expansion of these materials, however, tends to cause high degree of doming in electron radiation. Stated otherwise, these conventional materials are in general very poor in doming characteristics.

In an attempt to decrease doming in electron radiation, it is proposed to form shadow masks from Fe-Ni invar alloy. This alloy generally contains 36% by weight of Ni and Fe in balance.

In the field of electronic display devices, there is increasing demands for ultra-fine displays and flat-face configurations with high vision development. These recent trend, however, produces lots of difficult problems in production of shadow masks.

As stated above, soft-steel such as low-carbon rimmed steel and low-carbon Aluminum-killed steel are unsuited for production of shadow masks because of their high thermal expansion. They cause high degree of doming. This defect is amplified with increase in demand for ultra-fine display. Fe-Ni invar alloy plates are poorer in etching adaptability (etching-factor) than soft-steel plates and, as a consequence, it is very difficult to make mask openings at a small pore-pitch. The pore-pitch of the mask openings can be made smaller by reducing the mask thickness. A reduced mask thickness, however, lowers the rigidity of the mask after pressing and, as a consequence, the product, i.e. a Braun tube, including the mask cannot well withstand mechanical shocks applied thereto in transportation and/or use. The thermal expansion of an Fe-Ni invar alloy plate is from 1/7 to 1/10 of that of a soft-steel plate. However, the degree of doming of an Fe-Ni alloy plate is only about ⅓ of that of a soft-steel. This poor effect in reduction of doming is resulted from the relatively low thermal conductivity and large specific resistance of the Fe-Ni invar alloy.

SUMMARY OF THE INVENTION

It is the basic object of the present invention to provide Fe-Ni-Co alloy which assures low degree of doming when used for shadow masks.

It is another object of the present invention to provide Fe-Ni-Co alloy having excellent magnetic and mechanical properties without degrading its doming characteristics.

In accordance with the basic aspect of the present invention, an Fe-Ni-Co alloy contains 28 to 34% by weight of Ni, 2 to 7% by weight of Co, 0.1 to 1.0% by weight of Mn, 0.1, % by weight or less of Si, 0.01% by weight or less of C and Fe with indispensable impurities in balance; and has an average grain size in a range of 30 or less μm and 60 to 95% of crystal grains accumulated in a plane direction range of ±5 to 45 degrees deviated from the ideal plane direction of {100} [001].

In a preferred embodiment, 60 to 95% of crystal grains are oriented in a range of ±10 to 30 degrees deviated from the ideal orientation (preferred orientation) {100} [001].

DESCRIPTION OF THE PREFERRED EMBODIMENTS

Figure 1A:
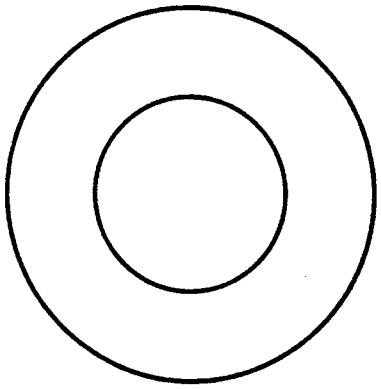
FIGS. 1A to 1C show the state of various openings formed in a shadow mask after etching.

In accordance with the basic aspect of the present invention, the Fe-Ni-Co alloy should contain 28 to 34% by weight of Ni. Presence of Ni in the alloy lowers its thermal expansion. However, as the content of Ni falls outside the specified limits, the thermal expansion of the alloy rises and the alloy becomes unsuited for production of a shadow mask.

The Fe-Ni-Co alloy in accordance with present invention should also contain 2 to 7% by weight of Co. Presence of Co in the alloy well upgrades its etching adaptability. However, any content outside the specified limit would raise the thermal expansion of the alloy which naturally becomes unsuited for production of a shadow mask.

0.1 to 1.0% by weight of Mn in the alloy much improves forging adaptability of the alloy. In adding, Mn acts as a deoxidizer. Any content below 0.1% would assure no appreciable improvement in forging adaptability. Any content above 1.0% would raise thermal expansion of the alloy. In addition, Mn starts to react with S, which is inevitably contained in the composition, to produce undesirable compounds.

Content of Si should be 0.10% by weight or less, Si is added for the purpose of deoxidation. As the content of Si exceeds 0.10% weight, 0.2% proof stress of the alloy is raised and, as a consequence, spring-back starts during cold and hot pressing operation, besides lowering etching adaptability. In the specified range, presence of Si assures good press adaptability and no production of undesirable compound through unavoidable reaction between Si and C as well as O. 0.01% by weight or less of C should be added for deoxidation purpose. Excessive content would produce carbides which, in corporation with C in solid solution, seriously degrades etching adaptability of the alloy. Further, raised 0.2% proof stress mars press adaptability of the alloy, and enlarges coercive force of the alloy, thereby greatly degrading it magnetic characteristics.

In accordance with the basic aspect of the present invention, the average grain size of the alloy should be 30 μm or less. Any average grain size over this limit would result in uneven etching, thereby lowering degree of circularity of etching in the shadow mask. A large grain size beyond the limit would induce the coarse grain after annealing, and then which induce a rough surface on the formed mask after pressing.

Further, 60 to 95% of grain accumulation should occur in a direction range of ±5 to 45 degrees deviated from the ideal orientation (preferred orientation) {100} [001]. The term "etching factor" refers to the ratio of etching depth with respect to the amount of side etching. This etching factor is improved when the {100} planes are collected on a rolling plane. The highest etching speed usually appears on the {100} planes. Such texture on the rolling plane is generally achieved by control of the recrystallization texture obtained after recrystallization annealing after high reduction rolling and after cold working after the recrystallization. When the degree of accumulation in the ideal orientation of {100} [001] is too high, etching develops along the crystal lattice during etching of a rolled plate into a shadow mask and the etched hole is irregular in profile and poor in degree of circularity as shown in FIG. 1C.

In order to improve the etching factor in formation of an desired hole, the crystal plane needs to be oriented to the {100} planes and the orientation in the {100} planes must have appreciable variation. When the {100} planes counted from the X-ray diffraction peak curve are less than 60%, the etching factor is degraded. When the {100} planes exceed 95%, degree of accumulation in the [001] direction is increased and the resultant hole is irregular in profile and poor in degree of circularity. When the degree of accumulation in the crystal direction is less than ±5 degrees deviated from the ideal orientation of {100} [001], too high accumulation occurs in the orientation of {100} [001] and the etched hole is irregular in profile and poor in circularity as shown in FIG. 1B. When the degree of accumulation in the crystal direction is more than ±45 degrees deviated from the ideal orientation of {100} [001], extreme fall is observed in the value of the etching factor and, as a result, the etched opening is again poor in degree of circularity as shown in FIG. 1C. Better circularity of the etched opening is obtained when the deviation is in a range of ±10 to 30 degrees.

A rolled plate of such a texture is produced in practice in the following manner. An ingot of a prescribed composition is first subjected to hot working followed by high reduction cold working. The degree of cold working (reduction ratio of cold working) is 60% or higher. Thereafter, recrystallization annealing is carried out at a temperature higher than the recrystallization temperature. This treatment raises degree of accumulation in the ideal orientation of {100} [001]. This annealing is further followed by cold working in order to disperse accumulation into different directions whilst maintaining the accumulation in the {100} planes, the degree of dispersion in direction can be freely controlled by proper choice of the degree of working in the cold working following the recrystallization annealing.

EXAMPLES

Example 1

Samples were first prepared from materials having compositions such as shown in Table 1.

TABLE 1

| Sample | Composition in % by weight | | | | | |
|---|---|---|---|---|---|---|
| | Ni | Co | C | Si | Mn | Fe |
| No. 1 | 30.0 | 6.8 | 0.004 | 0.03 | 0.33 | balance |
| 2 | " | " | " | " | " | " |
| 3 | " | " | " | " | " | " |
| 4 | 31.5 | 5.7 | 0.007 | 0.024 | 0.45 | " |
| 5 | 32.2 | 4.9 | 0.005 | 0.039 | 0.22 | " |
| 6 | " | " | " | " | " | " |
| 7 | " | " | " | " | " | " |
| 8 | 33.5 | 4.1 | 0.002 | 0.018 | 0.19 | " |
| 9 | 33.8 | 3.5 | 0.003 | 0.022 | 0.25 | " |
| 10 | " | " | " | " | " | " |
| 11 | " | " | " | " | " | " |
| C1 | 35.7 | 0 | 0.006 | 0.047 | 0.45 | " |
| C2 | " | " | " | " | " | " |
| C3 | " | " | " | " | " | " |
| C4 | 27.4 | 5.0 | " | 0.036 | 0.54 | " |
| C5 | 36.3 | 4.6 | 0.005 | 0.023 | 0.40 | " |
| C6 | " | " | " | " | " | " |
| C7 | " | " | " | " | " | " |
| C8 | 31.8 | 1.2 | 0.008 | 0.036 | 0.38 | " |
| C9 | 33.4 | 7.8 | 0.003 | 0.031 | 0.24 | " |

* C denotes comparative samples

For each sample, the materials were mixed and subjected to vacuum fusion to obtain an ingot which is then subjected to hot forging and hot rolling at a temperature in a range from 1100° to 1400° C. After surface grinding, a crude product was subjected to cold rolling at a degree of working above 80%, recrystalization annealing at a temperature in a range from 700° to 1100° C. and several stages of cold working at various degrees of working to obtain a thin plate of 0.15 mm thickness (Samples 1 to 11 and C1 to C9).

The Samples thus prepared were subjected to measurements of thermal expansion at temperatures in a range from 30° to 100° C., Young's modulus, 0.2% proof stress, rigidity after formation into shadow masks, the {100} degree of aggregation, degree of accumulation in the [001] direction, etching factor, profile of hole, degree of unevenness and degree of circularity. The results of the measurements are shown in Tables 2 and 3.

TABLE 2

| Sample | Thermal expansion $\alpha$ [$xE^{-7}$] | YOUNG'S modulus Kgf/mm$^2$ | 0.2% proof stress Kgf/mm$^2$ | Coersive force Hc[Oe] | RI | (100) DOA % |
|---|---|---|---|---|---|---|
| No. 1 | 12.2 | 16600 | 25.5 | 0.10 | 1.4 | 52 |
| 2 | " | " | " | " | " | 75 |
| 3 | " | " | " | " | " | 96 |
| 4 | 2.6 | " | 24.9 | 0.11 | " | 90 |
| 5 | 3.1 | 15700 | 24.8 | 0.12 | 1.3 | 65 |
| 6 | " | " | " | " | " | 81 |
| 7 | " | " | " | " | " | 90 |
| 8 | 10.1 | 15300 | 24.5 | 0.10 | " | 85 |
| 9 | 8.6 | 14800 | 23.1 | 0.14 | 1.2 | 42 |
| 10 | " | " | " | " | " | 78 |
| 11 | " | " | " | " | " | 97 |

TABLE 2-continued

| Sample | Thermal expansion α [xE$^{-7}$] | YOUNG'S modulus Kgf/mm$^2$ | 0.2% proof stress Kgf/mm$^2$ | Coersive force Hc[Oe] | RI | (100) DOA % |
|---|---|---|---|---|---|---|
| C1 | 16.1 | 13000 | 25.3 | 0.15 | 1 | 52 |
| C2 | " | " | " | " | " | 82 |
| C3 | " | " | " | " | " | 97 |
| C4 | 41.2 | 13300 | 27.3 | 0.38 | " | 86 |
| C5 | 36.4 | 13800 | 26.2 | 0.31 | 1.1 | 63 |
| C6 | " | " | " | " | " | 83 |
| C7 | " | " | " | " | " | 96 |
| C8 | 38.1 | 15200 | 23.2 | 0.16 | 1.3 | 83 |
| C9 | 31.8 | 15100 | 27.8 | 0.28 | " | 67 |

* RI = Rigidity index
(100) DOA = (100) Degree of accumulation

TABLE 3

| Sample | [001] DOA (°) | Grain size μm | EF | opening profile | DOU | DOC |
|---|---|---|---|---|---|---|
| No. 1 | ±48 | 35 | 2.5 | c | D | 0.98 |
| 2 | ±20 | 18 | 3.0 | a | A | 1.0 |
| 3 | ±4 | 13 | 3.3 | b | C | 0.96 |
| 4 | ±18 | 18 | 3.2 | a | B | 1.0 |
| 5 | ±35 | 28 | 2.8 | a | B | 0.99 |
| 6 | ±18 | 18 | 3.1 | a | A | 1.0 |
| 7 | ±12 | 16 | 3.3 | a | A | 1.0 |
| 8 | ±10 | 15 | 3.2 | a | A | 1.0 |
| 9 | ±46 | 40 | 2.5 | c | D | 0.98 |
| 10 | ±17 | 16 | 3.1 | a | A | 1.0 |
| 11 | ±4 | 13 | 3.3 | b | C | 0.93 |
| C1 | ±47 | 38 | 2.7 | c | D | 0.94 |
| C2 | ±13 | 17 | 3.1 | a | B | 1.0 |
| C3 | ±4 | 13 | 3.3 | b | D | 0.95 |
| C4 | ±16 | 18 | 3.1 | a | B | 1.0 |
| C5 | ±30 | 28 | 2.8 | a | D | 1.0 |
| C6 | ±18 | 19 | 3.1 | a | D | 1.0 |
| C7 | ±7 | 16 | 3.2 | b | B | 0.99 |
| C8 | ±12 | 21 | 3.1 | a | B | 1.0 |
| C9 | ±20 | 28 | 3.0 | a | B | 1.0 |

* [001] DOA = [001] degree of accumulation
EF = Etching factor
DOU = Degree of unevenness
DOC = Degree of circularity The measurements of the various properties were conducted under the following conditions;

The thermal expansion, 0.2% proof stress and Coercive force were measured after annealing in hydrogen at 1000° C. for 30 min.

The rigidity after formation into shadow masks was given in the form of a deformation load whilst taking that of the comparative Sample 1 as being equal to 1.

The {100} degree of accumulation was calculated from the following equation after X-ray diffraction tests;

$$\{100\}\text{ degree of accumulation in }\% = I(200)/\{I(111)+I(200)+I(220)+I(311)\}$$

Wherein
I (h kl) denotes the peak intensity of
X-ray diffraction in the orientation of (h kl).

Figure 2:
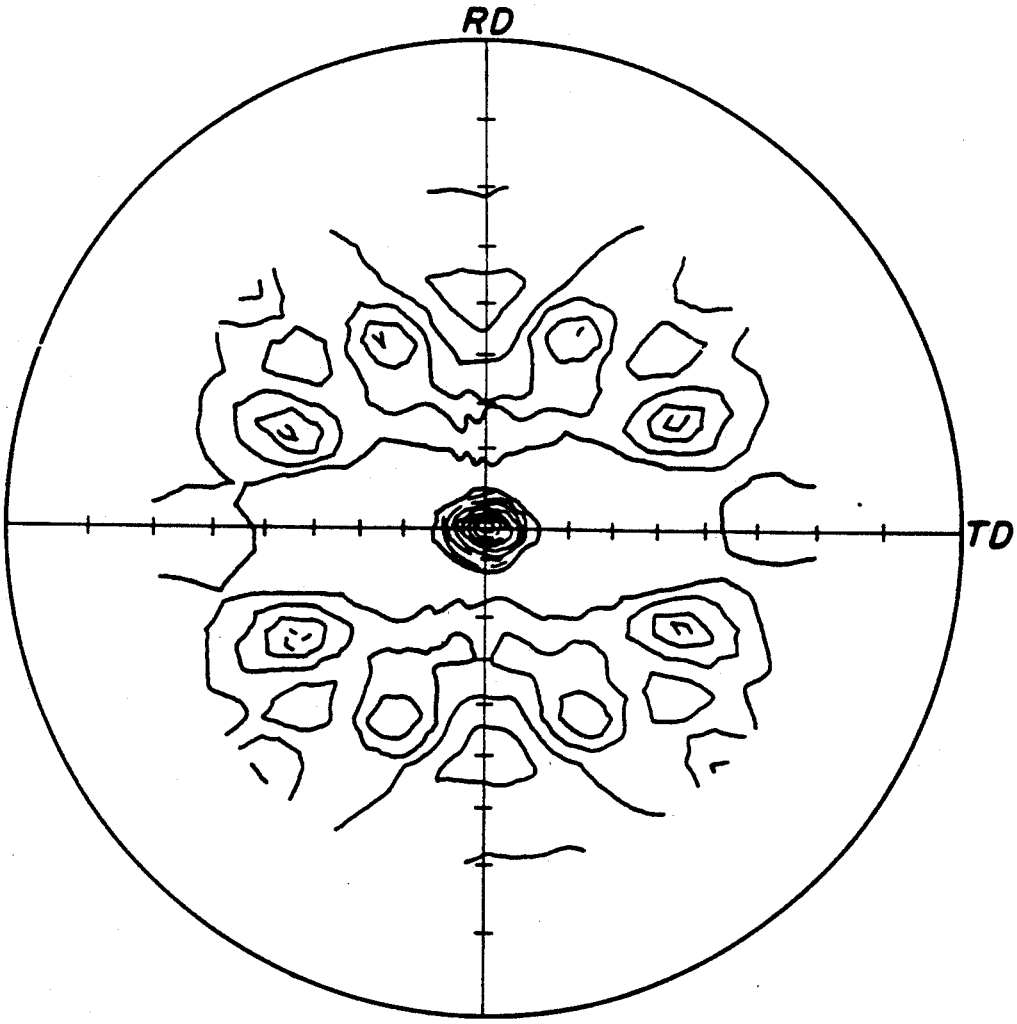
FIG. 2 shows the degree of orientation of the texture in Example 7 as (200) pole figure.
Figure 3:
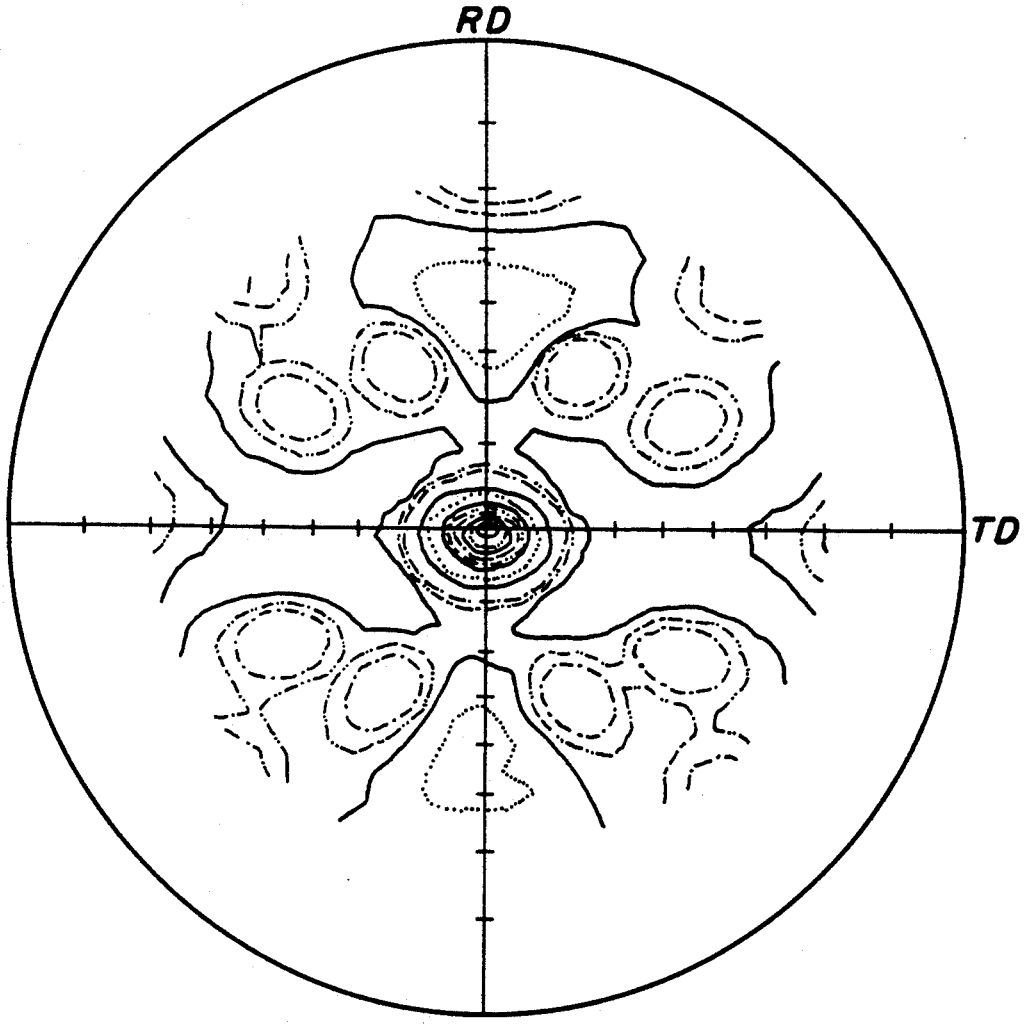
FIG. 3 shows the degree of accumulation of the aggregation in Example 2 as (200) pole figure.
Figure 4:
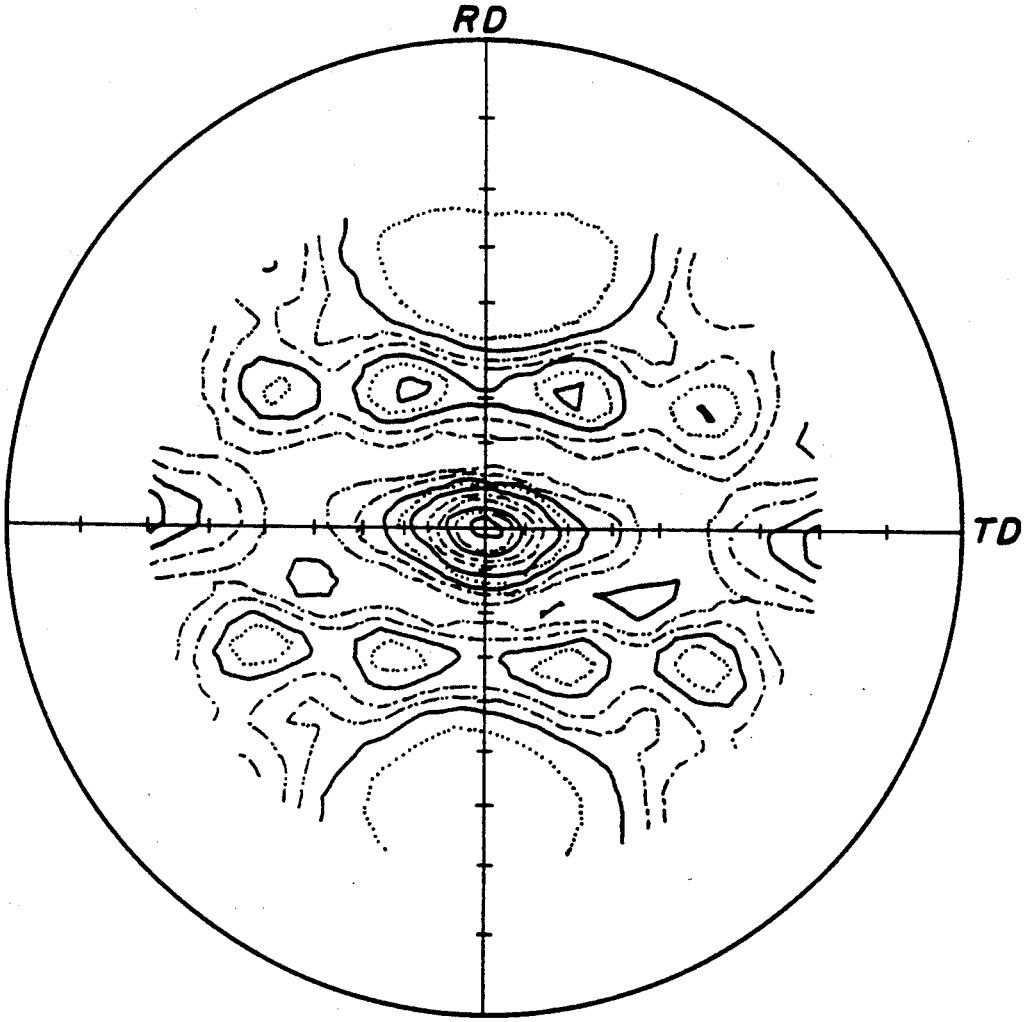
FIG. 4 shows the degree of accumulation of the aggregation in Example 5 as (200) pole figure.
Figure 5:
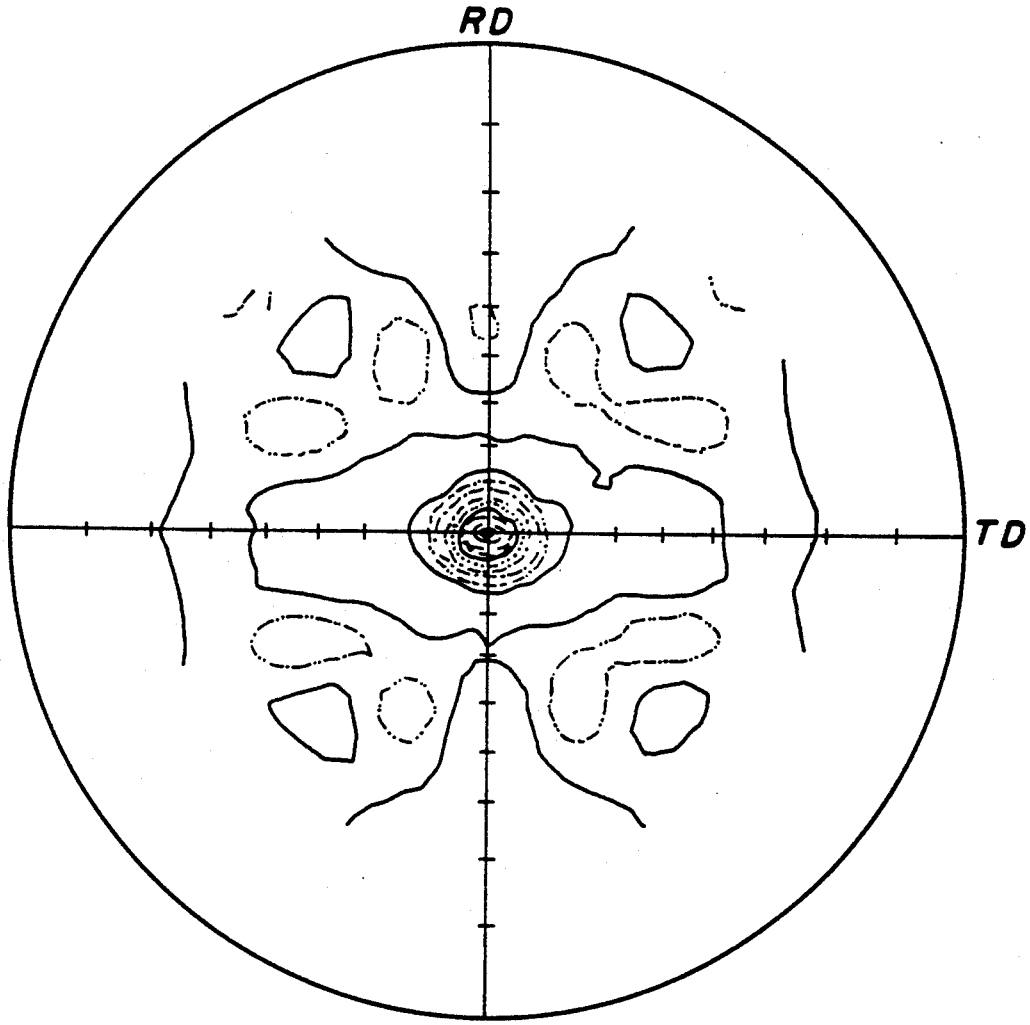
FIG. 5 shows the degree of accumulation of the aggregation in Example 2 as (200) pole figure.

The [001] degree of accumulation was given in the form of the angle of divergence of the contour lines from the center in the transverse direction or rolling direction in the (200) pole figure. Typical examples are shown in FIGS. 2 through 5. FIG. 2 is for Sample 7, FIG. 3 for Sample 2, FIG. 4 for Sample 5 and FIG. 4 for comparative Sample 2.

For measurement of the etching facter, spray etching by ferric chloride solution was applied to each of the Samples using a resist pattern of 100 μm. The etching factor was measured when the diameter of an etched hole reached 150 μm. The concentration of the etching solution was 42 Be', the temperature was 50° C. and the liquid pressure was 2.5 Kgf/cm$^2$.

Figure 1B:
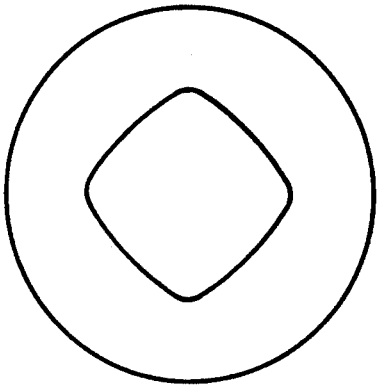
Figure 1C:
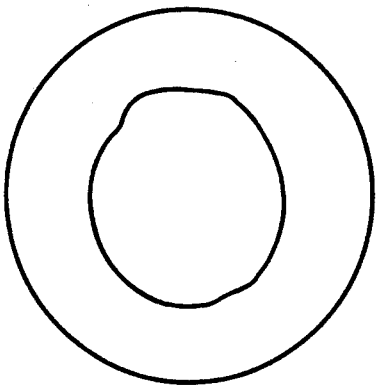

The profiles of the holes were classified into (a), (b) and (c) as shown in FIGS. 1A to 1C.

For measurement of the degree of unevenness, the entire surface of each shadow mask was evaluated and classified into three ranks A, B and C. No substantial unevenness was observed in the case of rank A. Samples of rank B were somewhat uneven in appearance but no problem in use was expected. Samples of rank C were quite uneven in appearance and unsuited for practical use. Intensive unevenness was observed in the case of rank D.

The degree of circularity was given by a ratio of the minimum distance with respect to the maximum distance between two parallel straight lines which sandwich an hole formed in the shadow mask.

Figure 6:
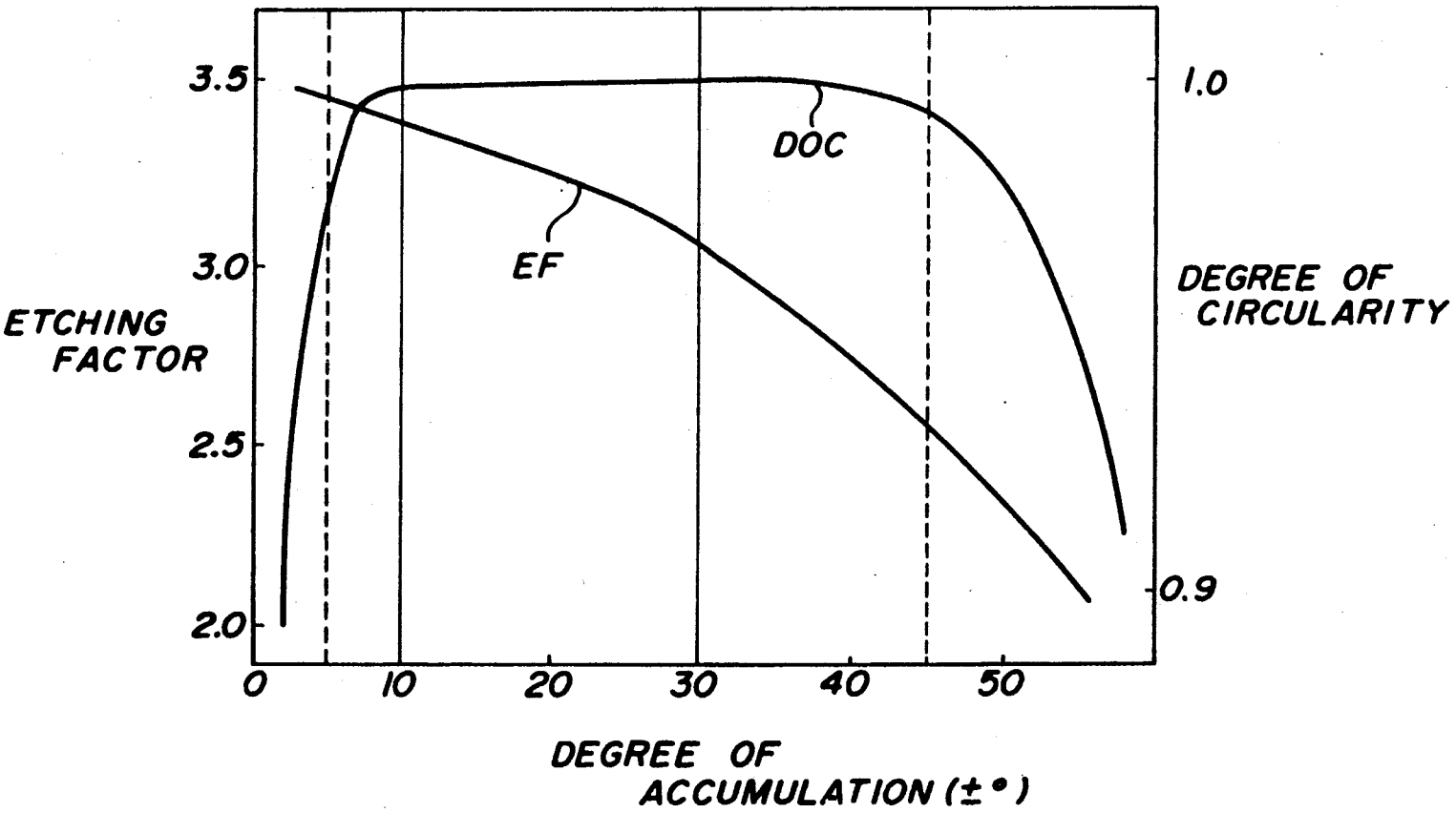
FIG. 6 is a graph for showing relationships between the directional degree of accumulation, the etching factor and the degree of circularity of an opening formed in a shadow mask.

FIG. 6 depicts the relationship between the [001] degree of accumulation, the etching factor and the degree of circularity for Sample 4. Like relationships were observed in the case of other Samples.

It is clearly endorsed by these technical data that, when compared with the comparative Samples, the Samples prepared in accordance with the present invention are much improved in thermal expansion, Young's modulus and rigidity after formation into shadow masks.

Accumulation of crystal grains in the specified plane direction range also assures significant improvements in etching factor, profile of hole and degree of unevenness.

Figure 7:
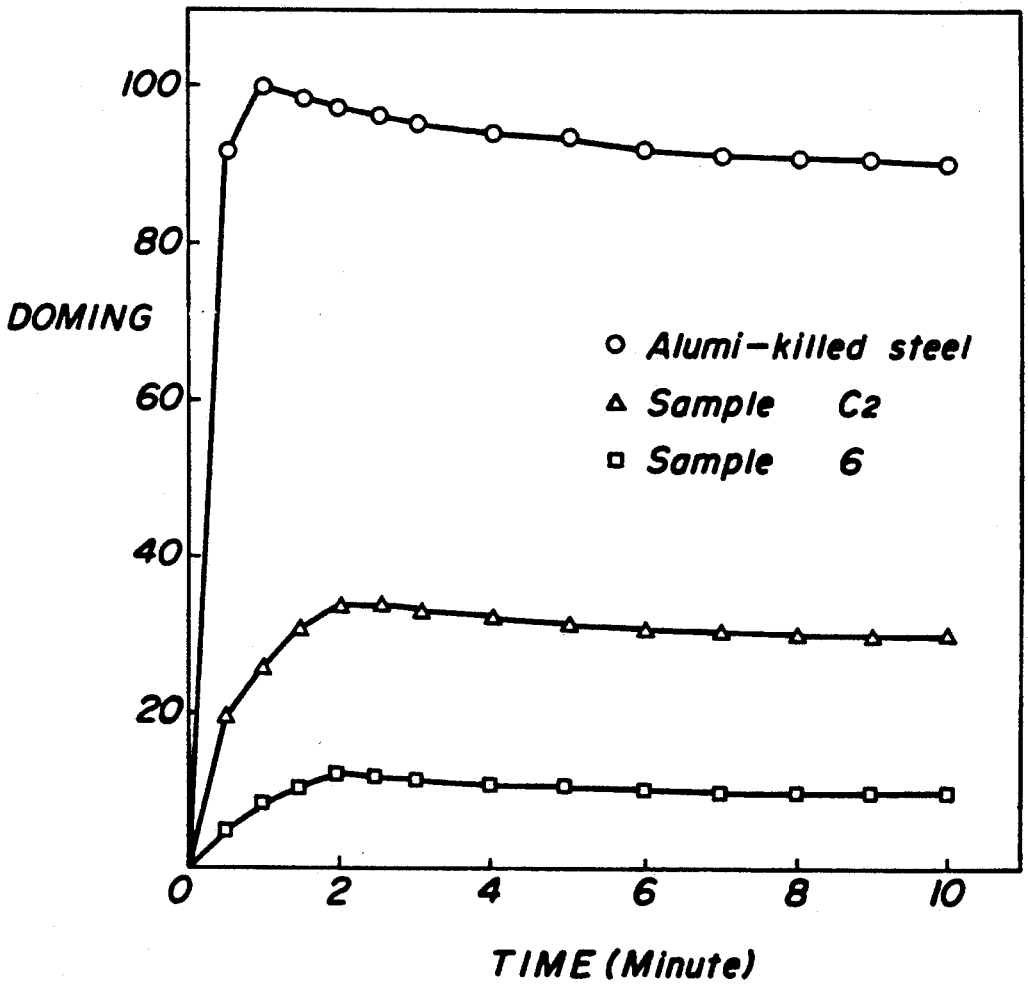
FIG. 7 is a graph for showing time-dependent change in doming characteristics.

FIG. 7 represents the doming characteristics when shadow masks of Samples 6, C1 and Aluminum-killed steel were used for a Braun tube, respectively. Time is taken on the abscissa and the value of doming is taken of the ordinate. It is clear from the illustration that the doming of the Sample 6 in accordance with the present invention is about 1/10 of that of the Sample made of Aluminum-killed steel.

We claim:

1. An Fe-Ni-Co alloy for a shadow mask containing 28 to 34% by weight of Ni, 2 to 7% by weight of Co, 0.1 to 1.0% by weight of Mn, 0.10% by weight or less of Si, 0.01% by weight or less of C and Fe with indispensable impurities in balance; and having an average grain size of 30 μm or less and 60 to 95% of crystal grains which are oriented in a range of ±5 to 45 degrees deviated from the ideal plane direction of {100} [001].

2. An Fe-Ni-Co alloy as claimed in claim 1 in which said 80 to 95% of crystal grains are oriented in a range of ±10 to 30 degrees deviated from said ideal orientation of {100} [001].

* * * * *

UNITED STATES PATENT AND TRADEMARK OFFICE

CERTIFICATE OF CORRECTION

PATENT NO. : 5,236,522
DATED : August 17, 1993
INVENTOR(S) : N. Fukuda, et al.

It is certified that error appears in the above-indentified patent and that said Letters Patent is hereby corrected as shown below:

On the title page of the above-identified patent, at item [75] Inventors, "Shizvoka" should read --Shizuoka--.

Signed and Sealed this

Tenth Day of May, 1994

Bruce Lehman

*Attest:*

BRUCE LEHMAN

*Attesting Officer*

*Commissioner of Patents and Trademarks*